US006379209B1

(12) United States Patent
Tucker

(10) Patent No.: US 6,379,209 B1
(45) Date of Patent: Apr. 30, 2002

(54) ALPHA-NUMERIC CHARACTER DISPLAY PANEL

(75) Inventor: Wayne R. Tucker, Volga, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/477,529

(22) Filed: Jan. 4, 2000

(51) Int. Cl.[7] ..... G09F 13/00; G09F 21/04
(52) U.S. Cl. ..... 445/24; 40/549; 40/591
(58) Field of Search ..... 445/24; 40/549, 40/591

(56) References Cited

U.S. PATENT DOCUMENTS 3,396,483 A * 8/1968 Stein et al. ..... 40/549
4,958,671 A * 9/1990 Bove ..... 160/135
5,149,921 A * 9/1992 Picardo ..... 187/317
5,365,411 A * 11/1994 Rycroft et al. ..... 362/20
5,695,346 A * 12/1997 Sekiguchi et al. ..... 434/365

* cited by examiner

*Primary Examiner*—Kenneth J. Ramsey
(74) *Attorney, Agent, or Firm*—Hugh D. Jaeger

(57) ABSTRACT

The present invention is for an alpha-numeric character display panel which is a low profile electronic alpha-numeric character display panel which utilizes pre-existing geometrically configured framework members. The low profile electronic alpha-numeric character display panel is of waterproof construction suitable for outdoor use and can be mounted in areas requiring minimal spatial impact with respect to depth.

2 Claims, 6 Drawing Sheets

ALPHA-NUMERIC CHARACTER DISPLAY PANEL

CROSS REFERENCES TO CO-PENDING APPLICATIONS

None.

BACKGROUND OF THE INVENTION

1. Field of the Invention

The present invention is for a digital display panel and, more particularly, is for a low profile electronic alpha-numeric character display panel which utilizes existing geometrically configured frameworks which can be mounted and utilized in existing panel members.

2. Description of the Prior Art

None.

SUMMARY OF THE INVENTION

The general purpose of the present invention is to provide an alpha-numeric character display panel for mounting where minimal impact to structure geometry is required. The construction of the present invention presents a low profile alpha-numeric character display panel which includes existing pre-manufactured framework members such as but not limited to frameworks for recreational vehicle windows. The alpha-numeric character display panel is best suited where limited depth displays are useful, examples of which could be the panels of a tractor trailer, recreational vehicle, signboard, scoreboard or the like. Often the sidewalls of tractor trailers, recreational vehicles and the like are of multiple layers. Mounting of prior art display panels of excessive depth would require the cutting of two or more sidewall layers, such as an outer panel and an inner panel, and would result in protrusion of an excessive depth prior art display panel through the inner panel which, in many cases, would be protrusion into an area such as the cargo area of a tractor trailer, thus exposing an excessive depth prior art display panel to potential damage, to say nothing of occupying cargo space. Visible protrusion into the compartments of a recreational vehicle could be undesirable and often retrofitting to include an excessive depth prior art display panel could be difficult as components adjacent to an inner panel layer could cause spatial interference. The present invention, an alpha-numeric character display panel, includes a rectangular-shaped shroud or other configured-shape shroud, a shallow pan secured to the rear of the shroud, a circuit board including light emitting diode pixels aligned closely to and within the shallow pan, and a substantially clear or masked viewing panel of appropriate glazing which mounts in a waterproof framework which covers the circuit board and rear shallow pan assembly, and thus provides for weatherproofing of the included assembly.

According to one embodiment of the present invention, there is provided an alpha-numeric character display panel of thin profile which can be mounted to a panel with minimal spatial impact to the surrounding structure, especially with regard to depth. The alpha-numeric character display panel includes a framework, a viewing panel which can be clear or masked which aligns to a rubber gasket in a channel of the framework, a circuit board having light emitting diode pixels for alpha-numeric or graphic display, and a shallow pan which secures to a shroud for accommodation of the circuit board.

One significant aspect and feature of the present invention is an alpha-numeric character display panel being of thin design.

Another significant aspect and feature of the present invention is an alpha-numeric character display panel which utilizes existing framework, thus reducing the requirement for startup tooling.

Still another significant aspect and feature of the present invention is an alpha-numeric character display panel which minimally impacts the area behind a mounting panel.

Yet another significant aspect and feature of the present invention is an alpha-numeric character display panel the electrical components of which are located behind existing geometrically configured frameworks.

Still another significant aspect and feature of the present invention is an alpha-numeric character display panel which is of waterproof construction.

Having thus described an embodiment of the present invention, it is the principal object of the present invention to provide an alpha-numeric character display panel.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
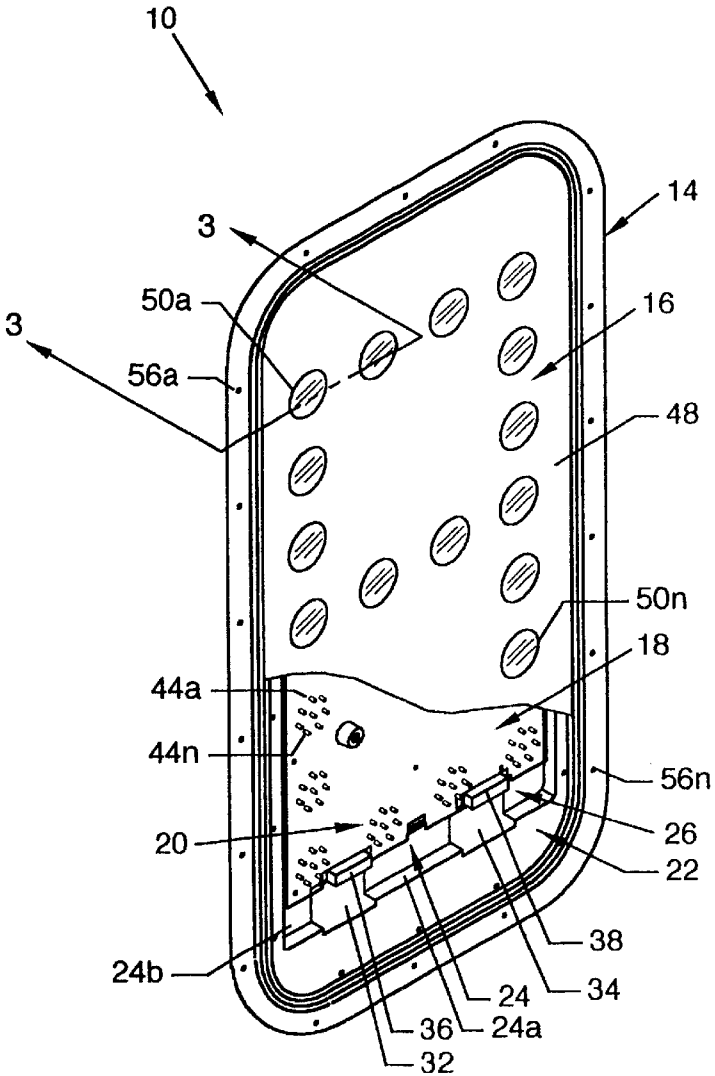
FIG. 1 illustrates an isometric cutaway view of the alpha-numeric character display panel.

FIG. 1 illustrates an isometric cutaway view of the alpha-numeric character display panel 10, the present invention. The major viewable components of the invention include a geometrically configured framework 14, a viewing panel 16 of appropriate glazing which may be clear or of masked construction which seals to the framework 14 to provide a waterproof structure, a circuit board 18 having LED pixels 20, a shroud 22, and a shallow pan 24 secured to the rear of the shroud 22.

Figure 2:
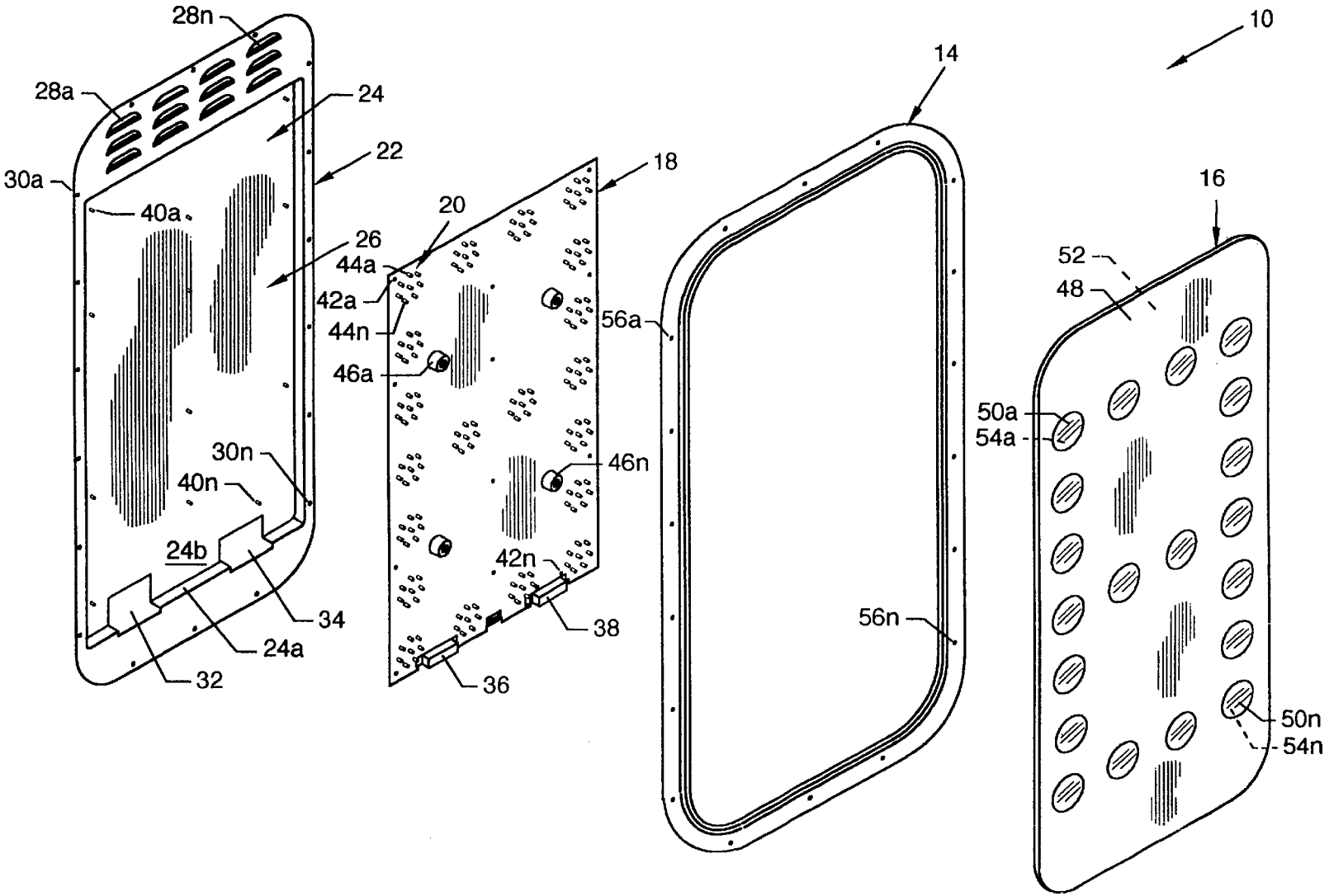
FIG. 2 illustrates an exploded isometric view of the alpha-numeric character display panel.

FIG. 2 illustrates an exploded isometric view of the alpha-numeric character display panel 10, where all numerals correspond to those elements previously or otherwise described. Pan 24, being of shallow construction, is suitably secured to the rear of the shroud 22 to provide a cavity 26 for the accommodation of the circuit board 18. In the alternative, the pan 24 can be integral to the shroud 22 such as by being formed by stamping or the like. The shroud 22 includes a plurality of louvers 28*a*–28*n* in the upper planar region as well as a plurality of body holes 30*a*–30*n* around and about the periphery of the shroud 22 which are incorporated to accommodate fasteners for fastening the shroud 22 and the included pan 24 and circuit board 18 to the rear of the framework 14. One or more cutouts such as cutouts 32 and 34 are provided at and extend partially along the bottom planar surface 24*a* of the pan 24 and extend into the rear planar surface 24*b* for access to one or more multi-pin connectors such as multi-pin connectors 36 and 38 located at the bottom edge of the circuit board 18. A plurality of standoffs 40*a*–40*n* extend from the rear planar surface 24*b* of the pan 24 for alignment with corresponding holes 42*a*–42*n* in the circuit board 18 for receiving fasteners for mounting of the circuit board 18 within the cavity 26 formed by the pan 24. Each of the individual pixels 20 includes a plurality of light emitting diodes (LED's) 44*a*–44*n*. The pixels 20 can be suitably arranged to provide numeric or alpha-numeric connotation as desired depending upon the required use. A plurality of spacers 46*a*–46*n* extend forwardly from the circuit board to provide support for the mid regions of the viewing panel 16.

Figure 3:
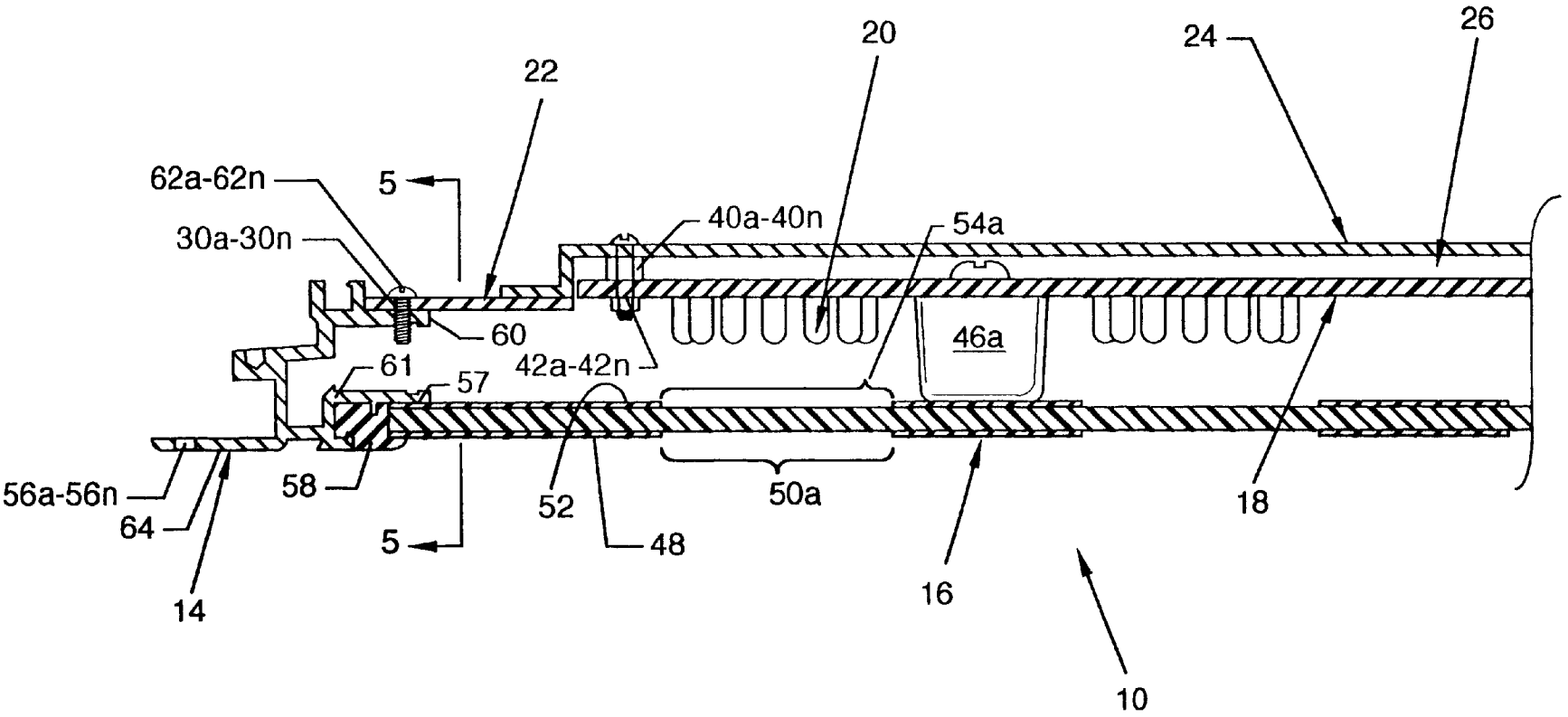
FIG. 3 illustrates a cross section view of the alpha-numeric character display panel along line 3—3 of FIG. 1.

Geometrically configured framework 14 accommodates and contains the viewing panel 16. The viewing panel 16 is preferably of transparent clear plastic or transparent colored plastic or of any suitable glazing material such as, but not limited to, clear or colored glass, shatterproof glass, Plexiglas® or any other suitable medium. The viewing panel 16 may include opaque masking on the front or rear planar side and can include front masking 48 having voids 50*a*–50*n* which can be of circular or other appropriate shape which are areas of no masking medium, and alternatively, as also illustrated in FIG. 3, may include rear masking 52 having voids 54*a*–54*n* which can be of circular or other appropriate shape which are areas of no masking medium. The viewing panel 16 can be entirely devoid of any masking medium, as desired. Front masking 48 and voids 50*a*–50*n* and opposing aligned rear masking 52 having aligned voids 54*a*–54*n* may also be utilized in combination, if desired. Passage of light generated by the LED's 44*a*–44*n* which correspondingly align with either voids 50*a*–50*n* or alternatively placed voids 54*a*–54*n* is permitted by the aligned voids 50*a*–50*n* or alternatively placed voids 54*a*–54*n*. The rear masking 52, with the exception of the voids 54*a*–54*n*, conceals the components of the circuit board 18 from frontal view. Voids 50*a*–50*n* in the front masking 48 provide a well defined and contrasting area of pixel viewing and/or light projection with respect to the pixels 20. A plurality of holes 56*a*–56*n* in the planar periphery of the geometrically configured framework 14 are included for suitably fastening the alpha-numeric character display panel 10 to the surface of a host panel surrounding a host panel mounting hole.

FIG. 3 illustrates a sectional view of the alpha-numeric character display panel 10 along line 3—3 of FIG. 1, where all numerals correspond to those elements previously or otherwise described. Illustrated in particular is the accommodation of the shroud 22, including the pan 24 and circuit board 18, at the rear of the geometrically configured framework 14 and of the viewing panel 16 at the front of the geometrically configured framework 14. A rubber gasket 58 is located in a channel 61 at the front of the geometrically configured framework 14 and accommodatingly mounts and seals the viewing panel 16 to the geometrically configured framework 14 to weatherproof the internally located compounds of the invention. Double-sided adhesive tape 57 is applied to an inner surface of the channel 61, as shown in detail in FIG. 5. A continuous flange 60, part of the geometrically configured framework 14, accommodates the shroud 22 which is secured thereto by a plurality of fasteners 62*a*–62*n* extending through the body holes 30*a*–30*n* in the shroud 22. A continuous flange 64 at the front of the geometrically configured framework 14 is provided for mounting of the geometrically configured framework 14 to a surface surrounding a mounting cutout region in a planar surface. The geometrically configured framework 14 can assume other geometric shapes for mounting of the viewing panel 16 and the shroud 22 containing the pan 24 and circuit board 18 and associated components and shall not be considered to be limiting to the scope of the invention.

Figure 4:
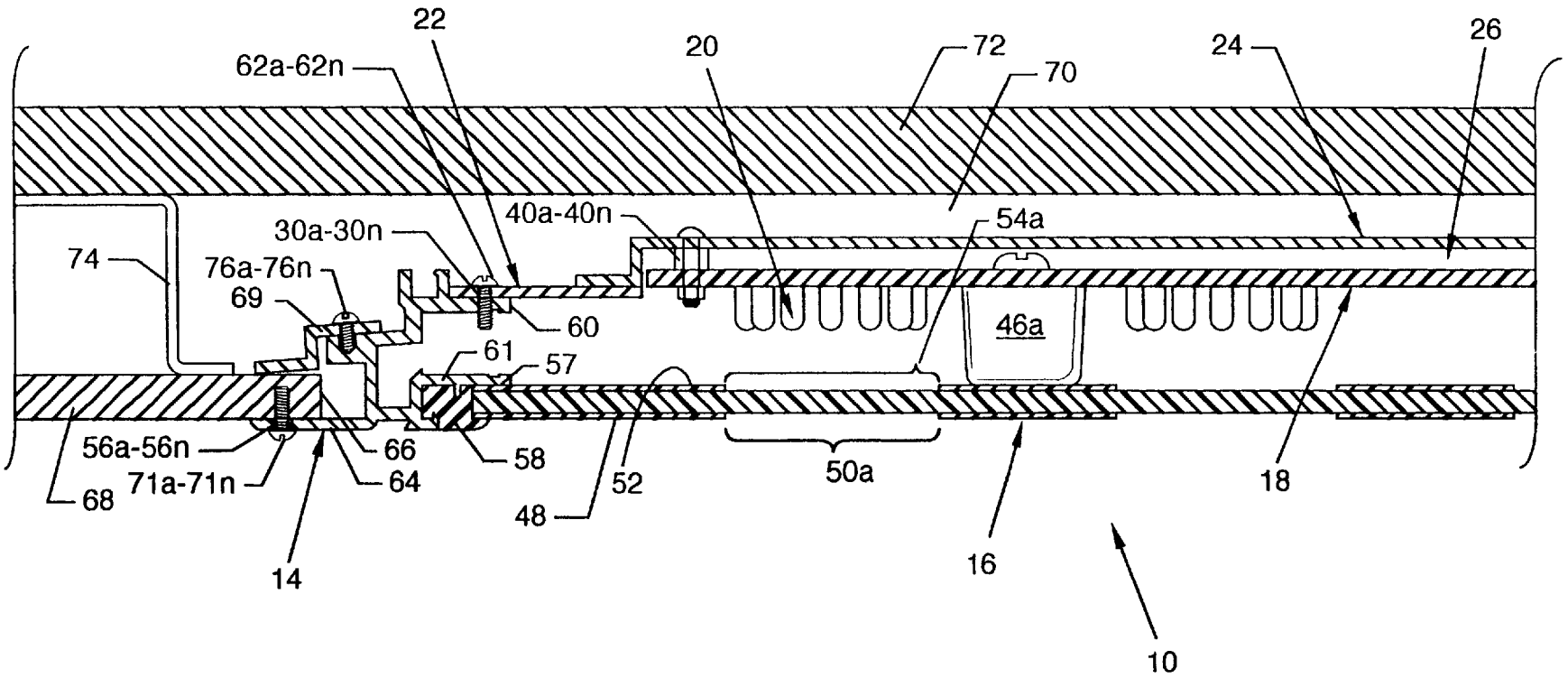
FIG. 4 illustrates the alpha-numeric character display panel of FIG. 3 mounted to a host panel.

FIG. 4 illustrates the sectional view of FIG. 3 where the alpha-numeric character display panel 10 has been mounted in a panel 68, where all numerals correspond to those elements previously or otherwise described. The alpha-numeric character display panel 10, the present invention, is illustrated mounted and secured about a cutout 66 in the host panel 68, which is an outer panel. As an alternative to a plurality of screws 71*a*–71*n* extending through holes 56*a*–56*n*, a clamp ring 69 and plurality of screws 76*a*–76*n* can secure the framework 14 to the outer host panel 68. The alpha-numeric character display panel 10, for purposes of example and illustration, aligns into a thin space 70 which is formed between the outer host panel 68, an inner panel 72 and one or more vertically oriented support channels 74, a portion of one of which is shown separating the outer panel 68 and the inner panel 72. of course, only one panel such as the outer panel 68 is actually required for mounting, but the inclusion of an inner panel 72 provides for protection of the invention from interfering objects such as but not limited to cargo residing in a tractor trailer.

Figure 5:
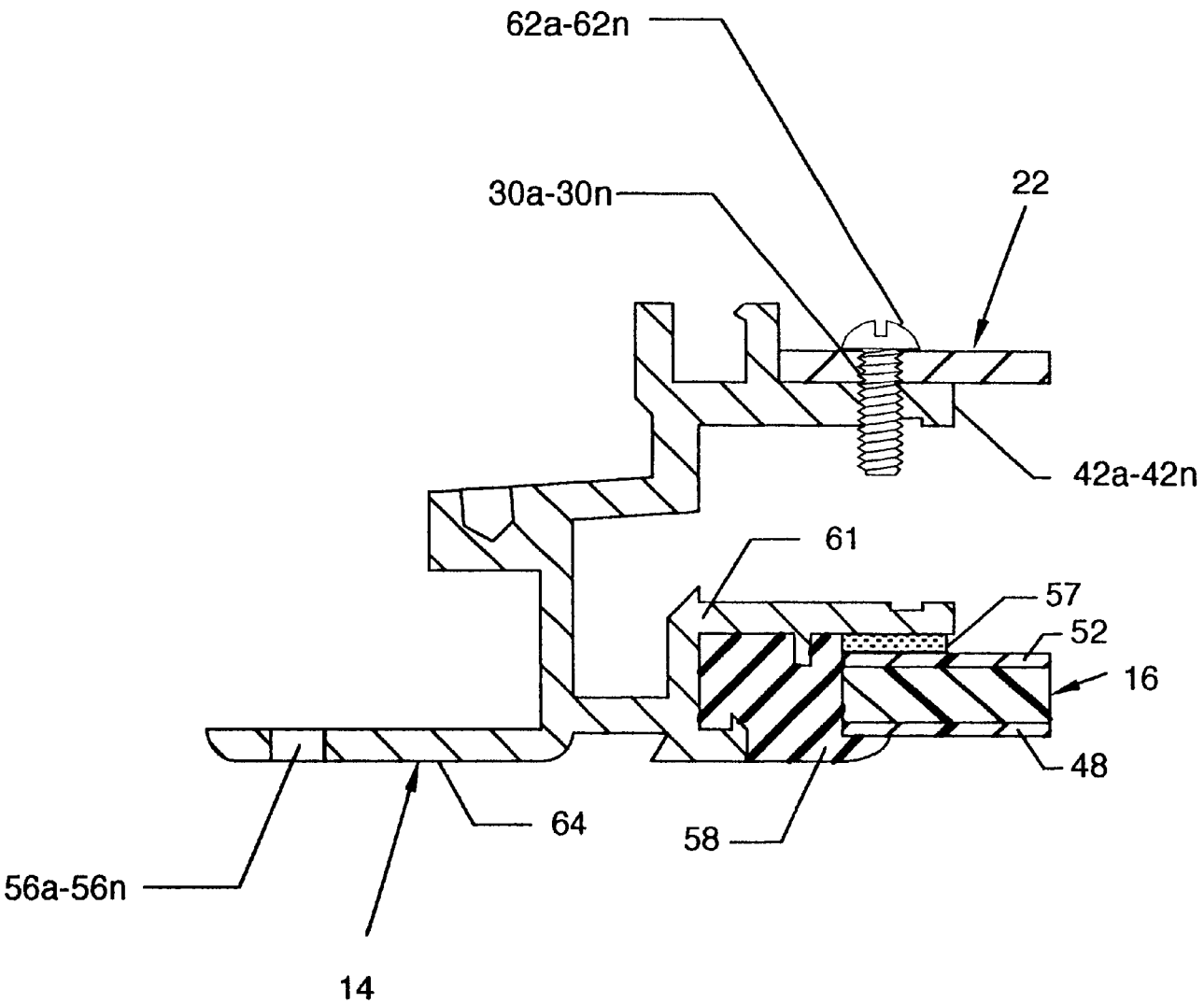
FIG. 5 illustrates a cross section view along line 5—5 of FIG. 3; and, FIG. 6 illustrates several alpha-numeric character display panels, the present invention, in use in the panels of a tractor trailer.

FIG. 5 illustrates a sectional view along line 5—5 of FIG. 3, where all numerals correspond to those elements previously or otherwise described. Illustrated in particular is the double-sided adhesive tape 57, one side of which adheres to an inner surface of the channel 61 and the other side of which adheres to the rear masking 52 of the viewing panel 61, or in the alternative, adheres directly to the viewing panel 16 if the rear masking 52 is not utilized. The rubber gasket 58 aligns in the interior of the channel 61 and fits closely around and about the edge of the viewing panel 16 to effect, along with the double-sided adhesive tape 57, a water-tight seal between the viewing panel 16 and the framework 14, thus providing a weatherproof interior for protection of the circuit board 18.

Figure 6:
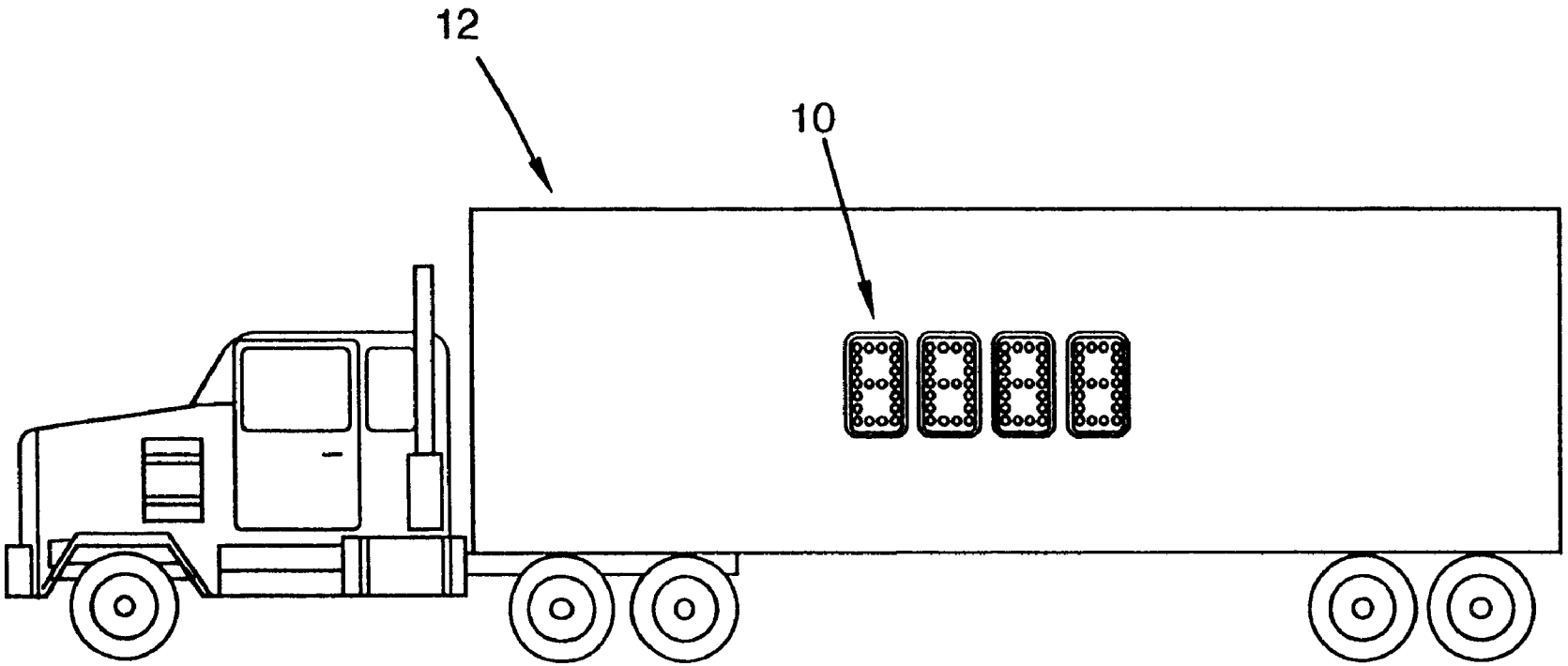

FIG. 6 illustrates several alpha-numeric character display panels 10, the present invention, in use, for purposes of example and illustration, in the side panels of a tractor trailer 12. The alpha-numeric character display panels 10 can be utilized for alpha-numeric display or graphics display with the addition of additional pixels 20, in other areas such as, but not limited to, recreational vehicles, sports score boards, stock market price displays and other numerous applications.

ALPHA-NUMERIC CHARACTER DISPLAY PANEL

PARTS LISTS

10 alpha-numeric character display panel
12 tractor trailer
14 framework
16 viewing panel
18 circuit board
20 pixel
22 shroud
24 pan
24*a* bottom planar surface
24*b* rear planar surface
26 cavity

28*a–n* louvers
30*a–n* body holes
32 cutout
34 cutout
36 multi-pin connector
38 multi-pin connector
40*a–n* standoffs
42*a–n* holes
44*a–n* LED's
46*a–n* spacers
48 front masking
50*a–n* circular voids
52 rear masking
54*a–n* voids
56*a–n* holes
57 double-sided adhesive tape
58 rubber gasket
60 flange
61 channel
62*a–n* fastener
64 flange
66 cutout
68 outer panel
69 clamp ring
70 space
71*a–n* screws
72 space
74 support channel
76*a–n* screws Various modifications can be made to the present invention without departing from the apparent scope hereof.

It is claimed:

1. Process for displaying an alpha-numeric character display panel in a thin physical structure comprising the steps of:

a. bending a frame from extruded material into a substantially closed predetermined geometrical configuration to form said frame;

b. inserting a polymer panel into said frame; and, c. mounting a printed circuit board having a plurality of clustered LED's to the edges of the frame, said circuit board with said LED's being spaced parallel and adjacent to said polymer panel to display said alpha-numeric display.

2. The process as in claim 1, further including a mounting flange on said frame, said polymer panel being mounted in said frame substantially flush with the outer surface of said mounting flange.

* * * * *